United States Patent [19]

Garkusha et al.

[11] 4,390,319

[45] Jun. 28, 1983

[54] TURBINE EXHAUST HOOD

[76] Inventors: Anatoly V. Garkusha, ulitsa 23 avgusta 63, kv. 82; Vladimir E. Dobrynin, pereulok Zernovoi, 6/4, kv. 49, both of Kharkov, U.S.S.R.

[21] Appl. No.: 263,997

[22] PCT Filed: Sep. 1, 1980

[86] PCT No.: PCT/SU80/00154

§ 371 Date: May 15, 1981

§ 102(e) Date: May 15, 1981

[87] PCT Pub. No.: WO81/00877

PCT Pub. Date: Apr. 2, 1981

[30] Foreign Application Priority Data

Sep. 25, 1979 [SU] U.S.S.R. ..... 2210400

[51] Int. Cl.[3] ..... F01D 25/30; F04D 29/56

[52] U.S. Cl. ..... 415/209; 415/127; 415/156; 415/158; 415/206; 415/219 B

[58] Field of Search ..... 415/127, 148, 156, 206, 415/209, 216, 219 B

[56] References Cited

U.S. PATENT DOCUMENTS

| | | | |
|---|---|---|---|
| 2,674,403 | 4/1954 | Whiton | 415/156 |
| 3,307,587 | 3/1967 | Rylatt | 415/219 B X |
| 4,013,378 | 3/1977 | Herzog | 415/209 |

*Primary Examiner*—Harvey C. Hornsby
*Assistant Examiner*—Arthur D. Dahlberg
*Attorney, Agent, or Firm*—McAulay, Fields, Fisher, Goldstein & Nissen

[57] ABSTRACT

A turbine exhaust hood has a flow passage (2) which accommodates a guide member (6) and a deflector (8). The deflector (8) is made from a resilient material and has, when in initial position, a form of a ring with a radial slit, with the axis of said ring being substantially aligned with the turbine axis (7). The deflector (8) is mounted for free movement along the turbine axis (7), which movement is enabled by a mechanism (10) connected with the deflector (8) so that with turbine operating at reduced loads, the deflector (8) forms, together with the guide (6) and the wall of the casing (1), a volute-shaped channel (11). The outlet section (11*a*) of the channel (11) is disposed at the place of the slit (9) of the ring (8).

4 Claims, 7 Drawing Figures

TURBINE EXHAUST HOOD

The present invention relates to turbine construction and more in particular to a turbine exhaust hood.

BACKGROUND OF THE INVENTION

There is known an exhaust hood which is positioned immediately after the last-stage blades of a turbine downstream of the working fluid.

The walls of the exhaust casing define a passage which is formed as an axial-radial diffuser at the inlet, and as a channel of rectangular cross section at the outlet.

Positioned at the passage inlet is a guide member which is provided to ensure without-separation flow of a working fluid during its turning or spreading in the axial-radial diffuser. The guide member is formed as a body of revolution, whose axis is aligned with that of the turbine, with one end thereof disposed in proximity with the last-stage blades of the turbine.

Positioned in the passage downstream from the guide member is a deflector which is also formed as a body of revolution, whose axis is in parallel with that of the turbine. The deflector is provided to permit aerodynamic force to act on the flow by altering the shape and flow area of the annular channels formed by the guide member and deflector, and by the deflector with the inside wall of the exhaust hood passage. This is achieved by that the deflector is displaced by means of a driving mechanism either in longitudinal and/or transverse directions relative to the turbine axis.

The exhaust hood construction described above fails to provide a required efficiency in the exhaust hood at under-load performance of the turbine, and does not ensure sufficient operating reliability of the turbine in the event the working fluid rates being less than $\frac{1}{3}$ of the nominal value.

It is known to those skilled in the art that "the rated load" of the turbine (and "the nominal working-fluid rate" which corresponds to the latter) is the load which assures maximum efficiency and operating reliability of the turbine.

With a decrease in the turbine load, followed by a decrease in the rates of a working fluid passing through the last stage of the turbine at a constant rotational speed of the turbine last-stage blades, the flow of the working fluid enters the exhaust hood as a rotating body. The circumferential velocity component is in general comparable with the axial velocity component, but in certain instances it may be considerably greater. The centrifugal forces in the rotational flow make for an increase in the radial velocity component, and for separation of the flow from the inside wall of the exhaust hood, whereby the efficiency and operating reliability of the turbine are impaired.

Therefore, by changing the flow areas of the annular channels at the inlet portion of the exhaust hood, it becomes possible to limit any further increase in the radial velocity component directly in the last stage of the turbine and after this stage. In this way it becomes feasible to obtain axi-symmetrical without-separation flow of the working fluid with the rates thereof ranging from nominal to approximately $\frac{1}{3}$ of the nominal. However, with the working fluid rates being less than $\frac{1}{3}$ of the nominal, even substantial changes in the flow area of the above-mentioned channels will not prevent the flow from separation from the inside wall of the axial-radial diffuser of the passage and directly in the last-stage blades, which impairs the operating reliability of the turbine.

Moreover, in the prior-art exhaust hood construction, with lower rated loads of the turbine, the flow of working fluid passes beyond the boundary of the axial-radial diffuser as a body rotating over the entire area of the diffuser, which leads to substantial mechanical losses of the flow energy required for the vortex formation in the main portion of the exhaust hood.

It has been experimentally found that the greater part of the working-fluid particles travel along the trajectories known to be non-optimal.

Thus, the prior-art exhaust hood not only fails to restore static pressure of the working fluid therein, but permits a drop in this pressure to take place from the exhaust inlet to its outlet, which reduces the efficiency of the turbine as a whole.

DISCLOSURE OF THE INVENTION

What is required is a turbine exhaust hood with a deflector constructed so as to permit the axi-symmetric without-separation flow of a working fluid to be produced in the last stage of a turbine, and to preclude the vortex formation in the passage of the exhaust hood over the entire load range of the turbine.

The invention provides a turbine exhaust hood with a flow passage formed by the walls of the exhaust casing and having a guide member placed at its inlet and formed as a body of revolution with the longitudinal axis thereof being in line with that of the turbine and arranged so that one end thereof is disposed in close proximity with the outside ends of the turbine last-stage blade and accommodating a deflector mounted therein for longitudinal movement along the turbine axis and intended to change the flow area of the exhaust passage, wherein, according to the invention, the deflector is formed of a resilient material and has a shape of a ring provided with at least one radial slit and positioned so that its axis is substantially aligned with that of the turbine, the deflector being moved along the turbine axis by means of a mechanism connected with the deflector in at least three points so that, with the turbine operating at reduced loads, the deflector forms, together with the guide member and the casing wall, a volute-shaped converging channel having its outlet section disposed at the ring slit.

Such structural arrangement allows for the axi-symmetric without-separation flow of the working fluid to be produced in the turbine last stage and ensures high operating efficiency to be gained in the exhaust hood by eliminating the possibility of vortex formation over the entire performance range of the turbine.

The volute shape of the channel is advantageous for the passage of the rotational flow, and the gradually increasing area of the converging channel makes for an increase in the flow rate of the working fluid while passing through this channel and provides for uniform distribution of the working fluid pressure therein.

The mechanism for driving the deflector is preferably provided with rods geared to a drive operable to enable reciprocation of these rods along the turbine axis and connected with the side flat surface of the deflector at least in two points equidistant from the deflector slit and in proximity therewith, and diametrically opposed to the deflector slit at one point.

This type of the driving mechanism is simple in construction and easy in operation.

The outside diameter of the deflector is preferably smaller in size than the inside diameter of the guide member, and the edge of the latter that faces the deflector is preferably shaped in conformity with the profile of the outside curvilinear surface of the deflector at its maximum bending.

As a result, the volute-shaped converging channel is made sufficiently leak-proof, the consumption of material for the manufacture of the guide member is reduced, and the optimal path for the working fluid outflow from this channel is ensured. In addition, the energy losses due to the friction of blades with working fluid are brought down.

The outlet section of the volute-shaped converging channel is preferably substantially parallel with the outlet section of the turbine exhaust hood.

Such arrangement of the outlet sections makes it possible for the particles of a working fluid to travel along the shortest possible trajectories in the passage of the exhaust hood, thereby providing for its maximum efficiency under various operating conditions of the turbine.

With the exhaust hood construction according to the invention it becomes possible, without reducing the exhaust efficiency at rated loads, to eliminate the axial flow asymmetry in the last stage and the vortex formation in the exhaust passage, which adversely affect operating reliability and efficiency of the turbine at other than rated loads.

The axial symmetry of the working fluid flow makes it possible to eliminate additional variable stresses in the wheel blades as well as additional mechanical losses therein, whereas by precluding the possibility of vortex formation in the flow near the wheel blades, it becomes feasible to protect the outside edges of the blades from corrosion.

The present invention permits the service life of the turbine blades to be increased, the operating reliability to be improved, the expenses for repair and maintenance of the turbine rotor to be cut down, and the turbine efficiency to be enhanced over the entire operating range thereof.

The invention will now be described, by way of example only, with reference to the accompanying drawings.

BEST MODE OF CARRYING OUT THE INVENTION

Figure 1:
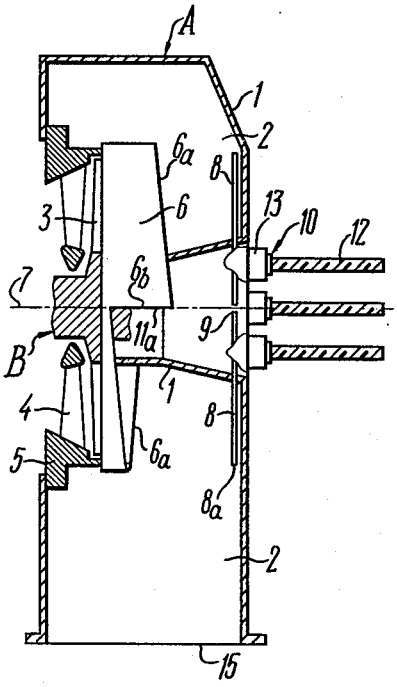
FIG. 1 is a schematic longitudinal view of a turbine exhaust hood with a deflector in initial position at which it is spaced at a maximum distance from the turbine last-stage blades, a guide member and a delector are not shown in cross section, and wherein there is also shown the outside surface of the casing wall at points of their connection with rods.

The turbine exhaust hood A (FIGS. 1, 2) of the invention has a stationary casing 1. The walls of the casing 1 form a passage 2 for a working fluid to pass from blades 3 of the turbine last stage B, which also incorporates stationary guide blades 4 secured on a stator 5. Placed at the inlet of the passage 2 is a guide member 6 formed as a body of revolution, a cylinder in this particular case. The guide 6 has its longitudinal axis 7 aligned with the turbine axis shown also at 7. The function of the guide 6 is to direct the flow of working fluid along a desired path after it leaves the turbine last stage B.

The guide 6 is positioned with its one end in close proximity to the outside ends of the blades 3 of the turbine last stage B. The guide 6 may be secured on the stator 5 by any conventional means not herein described for the sake of simplicity.

According to another embodiment of the invention, the guide 6 is mounted for free movement along the turbine axis 7.

Placed in the passage 2 of the exhaust hood A is a deflector 8 which is made from a resilient material and intended to form a channel of a given configuration.

Figure 3:
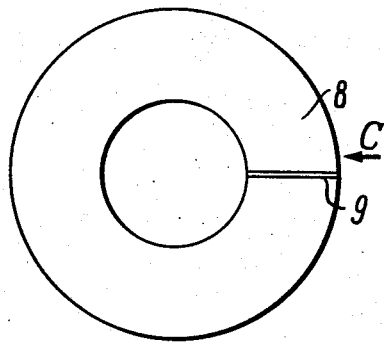
FIG. 3 is a plan view of a deflector in its initial position.
Figure 4:
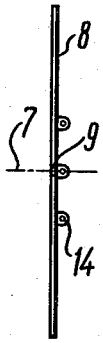
FIG. 4 shows a deflector as viewed along arrow C, with parts of joints through which it is connected with the rods of a mechanism enabling its axial movement while in initial position.
Figure 5:
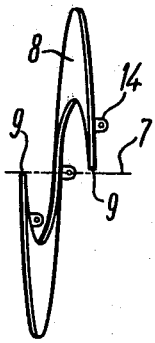
FIG. 5 same as in FIG. 4, with deflector in working position.

When in its initial position, such as shown in FIG. 1, the deflector 8 has a form of a ring, also shown at 8, with a radial slit 9. FIG. 3 is a plan view of the ring 8, FIG. 4 is a side view thereof, and FIG. 5 shows the ring 8 in a bent state. The deflector 8 has its axis substantially in line with the turbine axis 7, the deflector axis also shown at 7.

Figure 2:
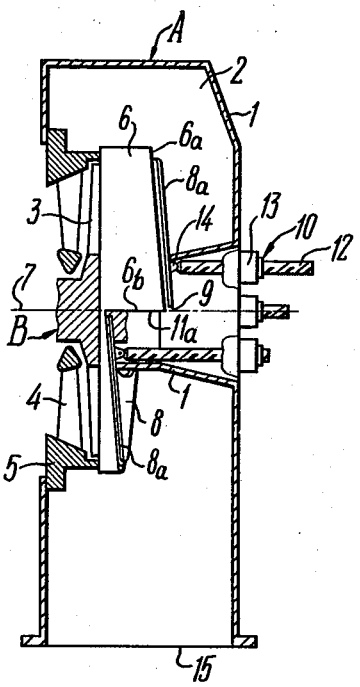
FIG. 2 same as FIG. 1, with the deflector in operating position at which it is subjected to maximum bending and with one end thereof disposed in the closest possible proximity with the turbine last-stage blades.

The deflector 8 is mounted for free movement along the turbine axis 7, which movement is enabled by a mechanism 10 (FIGS. 1, 2) connected with the deflector 8, in this case at three points. Thus, with the turbine running at a load below the rated values, the deflector 8 is positioned in close proximity to the blades 8, such as shown in FIG. 2. Then, when in the bent state, the deflector 8 forms, together with the guide 6 and the inside wall surface of the casing 1, a volute-shaped converging channel such as shown at 11 in FIG. 4, whose outlet area, shown at 11*a* in FIGS. 1, 2 and 4, is disposed in proximity with the slit 9 of the ring 8.

The volume-shaped converging channel 11 is provided to ensure maximum spreading of the working fluid in the exhaust hood A in the rotating flow outside the turbine last-stage blades 3, that is at a load below the rated value.

The driving mechanism 10 comprises three rods 12 (FIGS. 1, 2) each extending through a hole (not shown) in the wall of the casing 1 and connected to a respective drive 13 provided to enable reciprocation along the turbine axis 7.

Each drive 13 is mounted on the wall of the casing 1 and is secured thereon by any conventional means. The drive 13 may be either electric, hydraulic or any other servomotor suitable for the purpose.

According to another embodiment of the invention, there may be a greater number of the rods 12 in substantially uniform space relationship with one another.

Each rod 12 is threaded over its entire length to provide engagement with a mating member (not shown) of the drive 13.

Each rod 12 has its one end articulated at 14 (FIG. 2) to the side surface of the deflector 8 by any conventional means.

Two of the rods 12 are connected to the deflector 8 in proximity to the slit 9 in symmetry with the latter, the third rod being connected thereto at a point diametrically opposed to the slit 9, such as shown in FIGS. 4 and 5.

From the above it follows that the mechanism 10 for driving the deflector 8 is simple in construction and reliable in operation. In addition, it provides for a smooth movement and required bending of the deflector 8 as well as for the possibility to fix the latter in any desired position.

The outside diameter of the deflector 8 is slightly smaller in size than the inside diameter of the guide 6. Owing to this fact, the deflector 8 can be placed in the closest possible proximity with the blades 3 of the turbine last stage B.

Moreover, with free movement of the deflector 8 relative to the guide 6, the above diameter relationship makes it possible to change the curvature of the deflector 8 in the working position or, in other words, to vary the outlet section 11*a* of the volute-shaped converging channel 11 in accordance with the working fluid rates.

Figure 6:
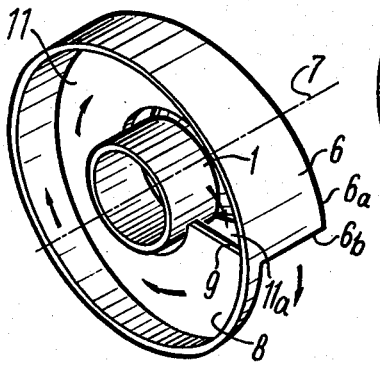
FIG. 6 is an isometric view of a volute-shaped converging channel, with the direction of the working fluid flow shown by arrows.

In this case, the edge 6*a* (FIGS. 1, 2 and 6) of the guide 6 conforms in shape to the curvilinear outer surface 8*a* of the deflector 8 in the state of its maximum bending.

The shape referred to above provides for relatively hermetic sealing of the volute-shaped converging channel 11 and permits sufficiently smooth outflow of the working fluid therefrom.

The profile of the outside curvilinear surface 8*a* of the deflector 8 is discontinued at the slit 9 and, correspondingly, the edge 6*a* of the guide 6 has a straight-line section 6*b* in the plane of the outlet section 11*a* of the volute-shaped converging channel 11.

In the exhaust hood A of the invention, the outlet area 11*a* of the volute-shaped converging channel 11 is substantially parallel to the outlet area 15 (FIGS. 1, 2) of the exhaust hood A.

Such disposition of the above outlet areas permits the working fluid to be discharged from the exhaust hood A along the shortest route equal to the perpendicular to these areas, whereby losses due to vortices are minimized.

Figure 7:
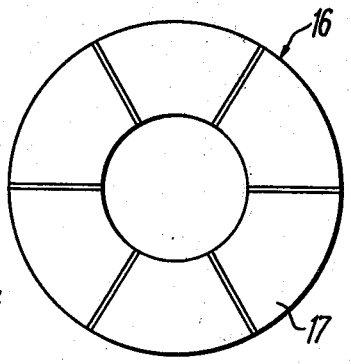
FIG. 7 shows an embodiment of the deflector when cut into six parts.

According to another embodiment of the invention, the exhaust hood A comprises a deflector 16 (FIG. 7) which has six radial slits forming six equal sections 17. Each section 17 is coupled to the mechanism 10 by means of the three rods 12 which enable individual movement for each section 17.

By dividing the deflector 16 into separate sections 17, it becomes possible to place them initially on the wall of the casing 1, if the latter is made curvilinear in shape, which widens the scope of application of such construction, provided the form of the exhaust hood A is selected primarily to meet the strength and compactness requirements and in the event when the use of the flat ring 8 is complicated.

The exhaust hood A in accordance with the present invention operates as follows.

At rated or close-to-rated loads, the deflector 8 occupies the extreme right-hand position, such as shown in FIG. 1, and has the form of a flat ring in intimate contact with the wall of the casing 1.

At a load below the rated value, the flow rate of the working fluid is reduced to cause rotation of the flow behind the blades 3 and an increase in the radial flow velocity component.

At certain periods, the drives 13 are automatically energized (in some cases, manually) in succession one after another, starting from the slit 9 of the deflector 8 and onwards in the direction of rotation of the blades 3.

While moving in the left-hand direction, as shown in FIGS. 1, 2, the rods 12 force the deflector 8 to bend and move along the axis 7.

Once the lower rod 12 is in its extreme left-hand position, such as shown in FIG. 2, all the drives 13 are deenergized. In the passage 2 of the exhaust hood A there is formed the volute-shaped converging channel 11 defined by the deflector 8, guide 6 and the wall of the casing 1.

From the outlet section 11*a* of the channel 11, the flow passes substantially normal to the outlet section 11*a* towards the outlet section 15 of the exhaust hood A, whereby use is made of the circumferential velocity component of the flow emerging from the blades 3. In other words, operating efficiency is enhanced in the exhaust hood A.

With the exhaust hood of the invention it becomes possible to eliminate vortex formation, practically over the entire load range of the turbine, in the area close to the blades 3 of the last stage B, and throughout the passage 2 of the exhaust hood A. In addition, the pressure of the working volume is made uniform over the entire working volume of the turbine, whereby its operating efficiency and reliability are enhanced.

The specimens of the proposed exhaust hood have been thoroughly tested to confirm its high efficiency obtained at various operating loads of the turbine.

INDUSTRIAL APPLICABILITY

The present invention is adapted to application in axial-flow turbines with non-axisymmetric outflow of working fluid.

The invention can be used to advantage in gas and steam turbines for driving electric generators blowers, ship propellers and other mechanisms operable at variable working-fluid rates and at variable frequency of rotor rotation.

We claim:

1. A turbine exhaust hood with a flow passage formed by the walls of a casing and having a guide member placed at its inlet and formed as a body of revolution with the longitudinal axis thereof being in line with that of the turbine and arranged so that one end thereof is disposed in close proximity with the outside ends of the turbine last-stage blade and accommodating a deflector mounted therein for longitudinal movement along the turbine axis and intended to change the flow area of the exhaust passage, characterized in that the deflector (8) is formed of a resilient material and has, when in initial position, a form of a ring (8) provided with at least one radial slit and positioned so that its axis is substantially aligned with the turbine axis (7), the deflector (8) being moved along the turbine axis (7) by means of a mechanism (10) connected with the deflector (8) in at least three points so that, with the turbine operating at reduced loads, the deflector (8) forms, together with the guide (6) and the wall of the casing (1), a volute-shaped converging channel (11) having its outlet section disposed at the slit (9) of the ring (8).

2. A turbine exhaust hood of claim 1, characterized in that the mechanism (10) incorporates rods (12) geared to a drive (13) operable to enable reciprocation of these rods along the turbine axis (7) and connected with the side flat surface of the deflector (8) at least in two points equidistant from the deflector (8) and in proximity therewith, and diametrically opposed to the slit (9) thereof.

3. A turbine exhaust hood of claim 1, characterized in that the outside diameter of the deflector (8) is slightly smaller in size than the inside diameter of the guide member (6), and the edge (**6*a*) of the guide member (6) that faces the deflector (8) is shaped in conformity with the profile of the outside curvilinear surface (8*a*) of the deflector 8** when in the state of its maximum bending.

4. A turbine exhaust hood of claim 1, characterized in that the outlet section (**11*a*) of the volute-shaped converging channel (11) is substantially in parallel to the outlet section (15**) of the turbine exhaust hood (A).

* * * * *